United States Patent [19]

Boulton

[11] 4,141,814

[45] Feb. 27, 1979

[54] DIAPHRAGM CELL

[75] Inventor: Thomas W. Boulton, Runcorn, England

[73] Assignee: Imperial Chemical Industries Limited, London, England

[21] Appl. No.: 817,672

[22] Filed: Jul. 21, 1977

[30] Foreign Application Priority Data

Aug. 4, 1976 [GB] United Kingdom ..... 32486/76
Aug. 4, 1976 [GB] United Kingdom ..... 32488/76
Sep. 9, 1976 [GB] United Kingdom ..... 37387/76

[51] Int. Cl.[2] ..... C25B 9/00; C25B 11/02; C25B 11/10; C25B 13/04

[52] U.S. Cl. ..... 204/252; 204/284; 204/288; 204/290 F; 204/296

[58] Field of Search ..... 204/290 F, 252–266, 204/284, 288, 289, 296

[56] References Cited

U.S. PATENT DOCUMENTS

| | | | |
|---|---|---|---|
| 2,682,505 | 6/1954 | Greco | 204/256 X |
| 3,507,771 | 4/1970 | Doïges et al. | 204/290 F X |
| 4,017,375 | 4/1977 | Pohto | 204/255 |
| 4,046,665 | 9/1977 | Westerlund | 204/252 X |
| 4,059,495 | 11/1977 | de Nova et al. | 204/266 X |
| 4,059,500 | 11/1977 | Kamarian | 204/289 X |

FOREIGN PATENT DOCUMENTS

| | | | |
|---|---|---|---|
| 563393 | 11/1932 | Fed. Rep. of Germany | 204/252 |

*Primary Examiner*—John H. Mack
*Assistant Examiner*—D. R. Valentine
*Attorney, Agent, or Firm*—Cushman, Darby & Cushman

[57] ABSTRACT

An anode suitable for use in a chlor-alkali diaphragm cell comprised of two groups of coated film-forming metal parallel elongated members lying in separate diverging planes which are connected to each other. The members (e.g. wires, louvers) extend lengthwise from the point of connection.

10 Claims, 5 Drawing Figures

DIAPHRAGM CELL

This invention relates to improvements in electrolytic diaphragm cells.

More particularly, it relates to electrolytic diaphragm cells having anodes made from a film-forming metal and which carry an electrocatalytically-active coating. It especially relates to diaphragm cells for the electrolysis of aqueous solutions of alkali-metal halides.

A wide variety of diaphragm cells are known which consist in principle of a series of anodes and a series of cathodes disposed in a parallel alternating manner and separated from each other by a substantially vertical diaphragm. In cells of recent design, the anodes are suitably in the form of plates of a film-forming metal (usually titanium) and carry an electrocatalytically-active coating (for example a platinum group metal oxide); the cathodes are suitably in the form of a perforated plate or gauze of metal (usually mild steel); and the diaphragms, which are usually deposited on or fitted to the surface of the cathodes, are suitably made of asbestos or a synthetic organic polymeric material, for example polytetrafluoroethylene or polyvinylidene fluoride.

In operating a diaphragm cell, it is advantageous to operate with as small a distance as possible between the anode and the cathode (the anode/cathode gap) in order to keep the ohmic losses (and hence the cell voltage) to a minimum. At the same time it is desirable to operate at an economic current density, for example 2 $kA/m^2$.

The use of high current densities results in a high rate of evolution of gas (for example chlorine) during electrolysis and if this evolution takes place in a narrow anode/cathode gap it can in turn cause a foam of gas and electrolyte. This foam can partially fill the anode/-cathode gap in the anolyte compartment, thus driving the electrolyte out of the gap and increasing the resistance to further electrolysis. This problem has been mitigated by using metal anodes provided with a plurality of vertically-disposed elongated members (e.g. blades, rods, channel-shaped members) to facilitate the removal of gas from the surface, for example as described in our copending UK Application Nos. 44682/73 and 29683/74 (published as Belgian Patent Specification No. 820295). Such metal anodes, when made of a film-forming metal, for example titanium, are relatively expensive to make as compared with solid-plate anodes. On the other hand, solid-plate anodes have a further disadvantage in that the relatively low electrical conductivity of a film-forming metal can lead to poor current efficiency in the cell. In certain diaphragm cells, the current is led into the bottom of the anode, and because of the relatively low electrical conductivity of titanium, there is a considerable voltage drop from bottom to top of the anode. This voltage drop can lead to reduction in current efficiency by causing a mal-distribution of current in the anode/cathode gap.

We have now devised an anode which aims to obviate of mitigate this disadvantage associated with the aforesaid anodes.

According to the present invention we provide an anode comprising two groups of substantially parallel elongated members made of a film-forming metal or alloy thereof carrying on at least part of their surfaces an electrocatalytically active coating, the members in each group lying in separate planes and being electrically conductively connected to each other and extending lengthwise from the point of connection, the planes facing each other and diverging from each other with increase in distance from the point of connection.

According to a further aspect of the present invention we provide an electrolytic cell comprising a plurality of anodes, a plurality of cathodes and diaphragms separating the anodes and the cathodes wherein each anode is according to the invention and wherein the anode/cathode gap of adjacent anodes and cathodes decreases from the bottom of the anodes, where the elongated members comprising the anodes are connected, to the top of the anodes.

The planes of the anodes are substantially rectangular or square, and the elongated members defining an edge of one plane are electrically conductively connected to the members defining an edge of the other plane so that the two planes diverge from the edges that are connected.

The elongated members may suitably be in the form of blades, rods, wires or channel members of U-shaped or hemicylindrical shape, or slotted plates. It is preferred that the elongated members are in the form of wires, or as slotted plates, especially louvred plates. The louvres are conveniently produced from a single sheet of film-forming metal by pressing with a slitting and forming tool. The louvres so obtained may suitably be turned at right angles to the original plane of the film-forming metal sheet, but they may be inclined to the plane if desired, or they may be rolled round to form a series of approximately hemicylindrical members which alternate with the slots from which the metal forming them has been pressed out. The louvres are preferably inclined at 60° to the plane of the sheet.

The planes of elongated members comprising the anodes are preferably connected together by mounting on a support, for example by mounting on a bridgepiece of a film-forming metal, for example titanium. The bridgepiece is conveniently in the form of a rectangular block which may connected to the planes of elongated members by any convenient means, for example resistance seam welding.

The anode may be mechanically and electrically connected to the baseplate of the cell, for example a plate of a film-forming metal such as titanium, by any convenient method, for example by capacitor discharge stud welding or argon arc welding. The anodes may be mounted directly on the baseplate, but are more conveniently mounted on a studs of a film-forming metal (for example titanium) which are already mounted on the baseplate, the studs being arranged in parallel rows on the baseplate and spaced apart from one another in each row. Such studs are conveniently mounted on the baseplate by means of capacitor discharge stud welding. In an especially preferred form, the anodes are mounted on a bridgepiece as described above, and the bridgpiece is then mounted, for example by argon arc welding on the studs which have already been pre-mounted on the baseplate. The film-forming metal baseplate may in turn be conductively bonded to a plate of iron or steel, for example a mild steel plate which serves as a conductor providing a low resistance electrical flow path between the anodes and copper connectors bolted to a side edge of the plate of iron or steel.

In this specification, by 'a film-forming metal' we mean one of the metals titanium, zirconium, niobium, tantalum or tungsten or an alloy consisting principally of one of these metals and having anodic polarisation properties which are comparable to those of the pure metal. It is preferred to use titanium alone or an alloy based on titanium and having polarisation properties comparable to those of titanium. Examples of such alloys are titanium-zirconium alloys containing up to 14% of zirconium, alloys of titanium with up to 5% of a platinum group metal such as platinum, rhodium or iridium and alloys of titanium with niobium or tantalum containing up to 10% of the alloying constituent.

The electrocatalytically active coating is a conductive coating which is resistant to electrochemical attack but is active in transferring electrons between electrolyte and the anode.

The electrocatalytically active material may suitably consist of one or more platinum group metals, i.e. platinum, rhodium, iridium, ruthenium, osmium and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chloride discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron, cobalt, nickel and mixtures thereof.

Especially suitable electrocatalytically active coatings according to the invention include platinum itself and those based on ruthenium dioxide/titanium dioxide and ruthenium dioxide/tin dioxide/titanium dioxide.

Other suitable coatings include those described in our UK Patent No 1402414 and UK Patent Application No. 49898/73 (Belgian Pat. No. 149867) in which a nonconducting particulate or fibrous refractory material is embedded in a matrix of electrocatalytically active material (of the type described above). Suitable nonconducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO.Al_2O_3$) aluminosilicates (e.g. mullite $(Al_2O_3)_3(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide, suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anodes may be prepared by the painting and firing technique, wherein a coating of metal and/or metal oxide is formed on the anode surface by applying a layer of a paint composition comprising thermally-decomposable compounds of each of the metals that are to feature in the finished coating in a liquid vehicle to the surface of the anode, drying the paint layer by evaporating the liquid vehicle and then firing the paint layer by heating the coated anode, suitably at 250° C. to 800° C., to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied on to a layer of the aforesaid paint composition while this is still in the fluid state on the surface of the anode, the paint layer then being dried by evaporation of the liquid vehicle and fired in the usual manner.

The coated electrodes are preferably built up by applying a plurality of paint layers on the anode, each layer being dried and fired before applying the next layer.

The cathode may suitably be in the form of a perforated metal sheet or gauze. The cathode is preferably of mild steel.

The anode may be used in conjunction with any conventional diaphragm. Suitable diaphragms include those made of asbestos or a synthetic organic polymeric material, for example polytetrafluoroethylene or polyvinylidene fluoride.

The anode/cathode gap is suitably in the range 3 to 10 mm, at the bottom of the anodes, and from to 0 to 6 mm at the top of the anodes, provided the gap at the bottom is greater than at the top.

The invention is especially applicable to diaphragm cells used for the manufacture of chlorine and alkali metal hydroxides by electrolysis of aqueous alkali metal chloride solutions, for example in diaphragm cells manufacturing chlorine and sodium hydroxide from sodium chloride solutions.

By way of example, embodiment of the invention will now be described with reference to the accompanying drawings in which.

Figure 1:
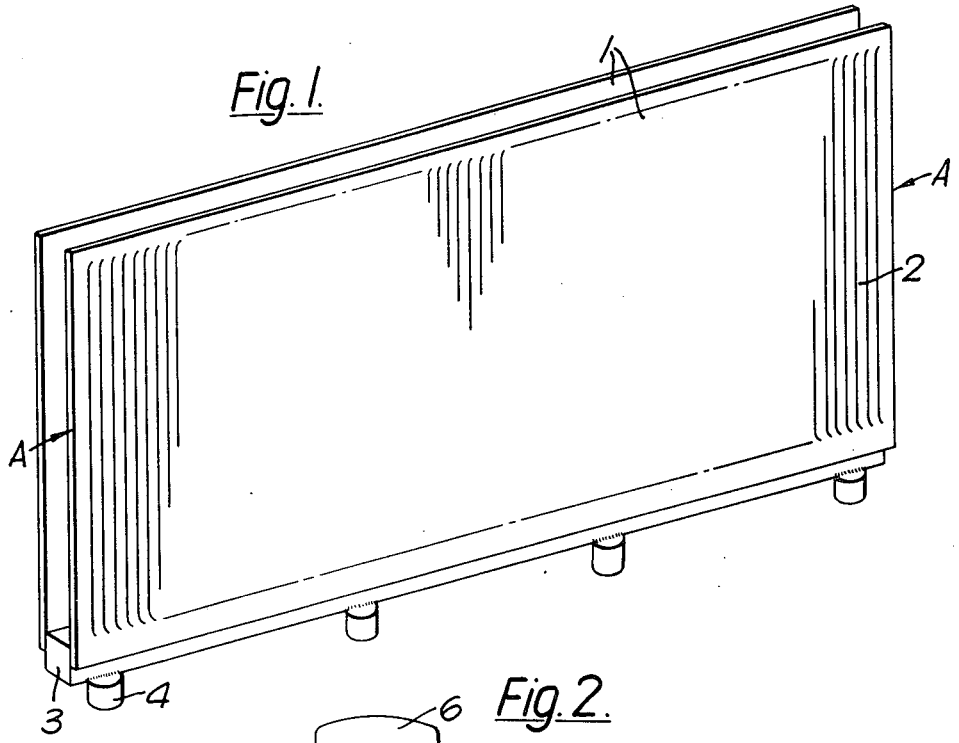
FIG. 1 is a diagrammatic view of an inclined louvred anode, according to the invention.
Figure 2:
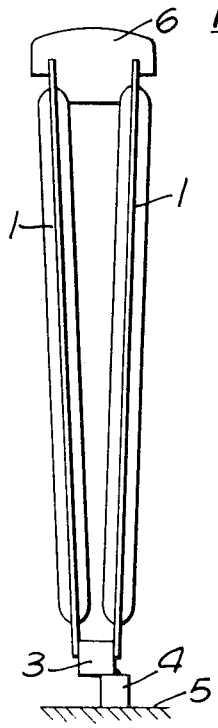
FIG. 2 is an end elevation of the louvred anode of FIG. 1 in combination with a spacer.
Figure 3:
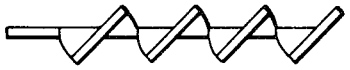
FIG. 3 is a section along the line A—A of FIG. 1.

Referring to FIGS. 1-3 of the drawings, the anode comprises a pair of anode plates fabricated of titanium and each having a plurality of vertical louvres 2. The louvres 2 are formed by pressing out with a slitting and forming tool from a single sheet of titanium (of a size corresponding to the overall dimensions of the anode).

The louvred anode plates are coated on both sides with an electrocatalytically active material, for example a coating comprising ruthenium oxide and titanium dioxide.

The plates 1 are inclined (as shown in FIG. 2) so that the separation of the plates increases from the bottom of the anode to the top. The cell comprises a plurality of such anodes in parallel array (not shown) so that the anode/cathode gaps of adjacent anodes and cathodes decrease from the bottom of the anodes to the top of the anodes in accordance with the invention. This advantageously reduces the electrolytic resistance in the vicinity of the upper half of the anodes, thereby leading to a more even distribution of current. Each pair of anode plates 1 is resistance seam welded at their lower ends to titanium bridge pieces 3. The titanium bridge pieces 3 are argon-arc welded to titanium studs 4 which have been previously mounted, for example by capacitor discharge stud welding to a titanium sheet 5 which serves as the base plate of the cell. The titanium base plate 5 is in turn conductively bonded to a mild steel slab (not shown) which serves as a conductor providing a low-resistance electrical flow path between the anodes 1 and copper connectors (not shown) bolted to a side edge of the mild steel slab.

The anode plates 1 are held in position during assembly by means of a cover strip, preferably of plastics material, which fits over the upper ends of said plates. This serves to prevent outward movement of plates 1 whilst assembling the anodes into the cell and reduces the risk of damage to the diaphragms. After assembling the anodes in the cell, the cover strip may be removed and replaced, if desired, by a spacer 6, conveniently of a plastics material, such as polyvinylidene fluoride, which serves to maintain pairs of anode plates 1 at the required inclination to produce the desired anode/cathode gaps.

Figure 4:
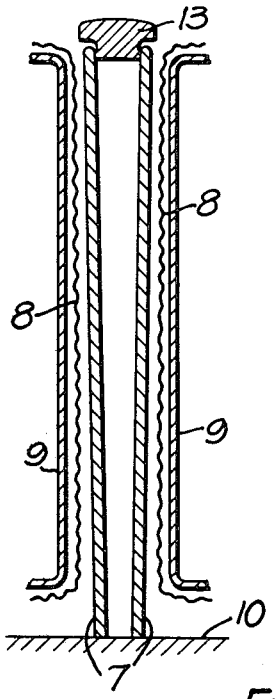
FIG. 4 is a sectional end elevation of an inclined wire anode according to the invention in combination with a spacer when mounted on the baseplate of a cell.
Figure 5:
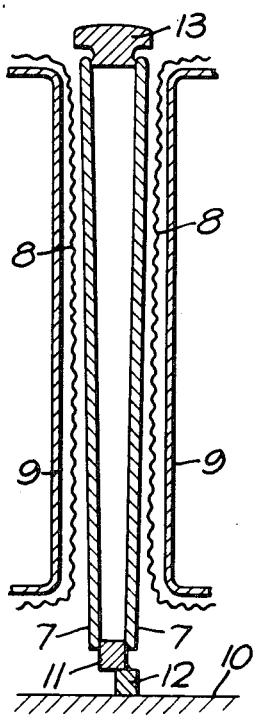
FIG. 5 is a sectional elevation of an inclined wire anode according to the invention in combination with a spacer when mounted indirectly on the baseplate of a cell.

Referring to FIGS. 4 and 5, the anode comprises two rows of inclined titanium wires 7 provided with an electrocatalytically active coating (e.g. ruthenium oxide/titanium dioxide). The rows are adjacent to diaphragms 8, e.g. of polytetrafluoroethylene or asbestos, which are adjacent to or deposited on cathodes 9, e.g. of mild steel gauze. The anode/cathode gaps, which decrease from the bottom of the anode to the top of the anode, are suitably in the range 3 to 10 mm at the bottom of the anode to 0 to 6 mm at the top of the anode. In the anode of FIG. 4, the titanium wires 7 are capacitor discharge stud welded at their lower ends to the titanium baseplate 10. In the anode of FIG. 5, the titanium wires 7 are resistance welded or argon-arc welded to a titanium bridgepiece 11, and the bridgepiece 11 is resistance welded or argon-arc welded to titanium studs 12 which are premounted on the baseplate 10, for example by capacitor discharge stud welding.

The titanium wires 7 are held in position during assembly by a cover strip (not shown), preferably of plastics material, and after assembly the cover strip is removed and replaced by a spacer 13, conveniently of a plastics material, such as polyvinylidene fluoride, which serves to maintain the pairs of wires 7 at the required inclination.

The invention was further illustrated by the following Example:

EXAMPLE

A diaphragm cell was provided with one pair of inclined titanium louvred anodes according to the invention, a mild steel gauze cathode and a polytetrafluoroethylene diaphragm. The anode/cathode gap was 6 mm at the bottom of the anode and 3 mm at the top of the anode. The polytetrafluoroethylene diaphragm was prepared by calendering a mixture of an aqueous polytetrafluoroethylene dispersion, titanium dioxide and starch, and subsequently removing the starch by electrolytic extraction in situ in the cell.

The cell was fed with sodium chloride brine (at a concentration of 310 g/litre). A current of 400 amps was passed through the cell, which corresponded to a current density of 2.0 $KA/m^2$ when compared with the effective area of the diaphragm. The cell operating voltage was 2.96 volts. The chlorine produced contained 93.0% chlorine and less than 2.0% oxygen. The aqueous sodium hydroxide produced contained 10% by weight of NaOH. The cell operated at a current efficiency of 96.0%.

What we claim is:

1. An electrolytic cell comprising a plurality of anodes, each of said anodes comprising two groups of substantially parallel elongated members made of a film-forming metal or alloy thereof carrying on at least part of their surfaces an electrocatalytically active coating, each group of members lying in separate planes and being electrically conductively connected to each other at the bottoms thereof and extending upwardly lengthwise from the area of connection, the planes facing each other and diverging from each other so that the distance therebetween increases gradually from the bottom to the top thereof, a plurality of upwardly extending cathodes, a plurality of diaphragms separating the anodes and cathodes, and the gap between each adjacent anode and cathode gradually decreasing from the bottom of each anode upwardly.

2. A cell as claimed in claim 1 wherein the anodes are mounted directly on the baseplate of the cell.

3. A claim as recited in claim 2 wherein the baseplate is of a film-forming metal or alloy thereof.

4. A cell as claimed in claim 1 wherein the anodes are mounted on studs of a film-forming metal or alloy thereof which studs have been premounted on the baseplate of the cell.

5. A cell as claimed in claim 4 wherein the baseplate is of a film-forming metal or alloy thereof.

6. A cell as claimed in claim 1 wherein the film-forming metal is titanium.

7. A cell as claimed in claim 1 wherein the anode/cathode gap is in the range from 3 to 10 mm at the bottom of the anodes to 0 to 6 mm at the top of the anodes.

8. A cell as claimed in claim 1 wherein the cathode is of mild steel gauze.

9. A cell as claimed in claim 1 wherein the diaphragm comprises asbestos.

10. A cell as claimed in claim 1 wherein the diaphragm comprises polytetrafluoroethylene or polyvinylidene fluoride.

* * * * *